United States Patent [19]

Haas, Jr.

[11] Patent Number: 4,486,010

[45] Date of Patent: Dec. 4, 1984

[54] JIG FOR HOLDING MEMBERS IN RADIAL ARRAY

[76] Inventor: Edward T. Haas, Jr., 6882 Trigo Rd., Goleta, Calif. 93017

[21] Appl. No.: 132,516

[22] Filed: Mar. 21, 1980

[51] Int. Cl.[3] ..... B25B 1/00

[52] U.S. Cl. ..... 269/3; 269/42; 269/153; 269/237; 279/35; 24/241 SP; 24/545; 24/567; 24/530

[58] Field of Search ..... 269/41, 42, 153, 237–239, 269/254 R, 287, 107–109, 1–3, 6; 279/35, 106; 24/252 A, 207, 208 R, 241 P, 241 SP

[56] References Cited

U.S. PATENT DOCUMENTS

| | | | |
|---|---|---|---|
| 10,635 | 3/1854 | Haskins | 24/252 A |
| 300,032 | 6/1884 | Thomas | 279/106 |
| 1,291,421 | 1/1919 | Coulter | 279/35 |
| 1,578,397 | 3/1926 | Cone | 279/35 |
| 2,356,198 | 8/1944 | Barry et al. | 279/110 |
| 2,686,058 | 8/1954 | Zetterberg | 279/110 |
| 3,159,408 | 12/1964 | Sanchez et al. | 279/35 |

FOREIGN PATENT DOCUMENTS

| | | | |
|---|---|---|---|
| 241477 | 11/1945 | Switzerland | 269/254 R |

*Primary Examiner*—Robert C. Watson
*Attorney, Agent, or Firm*—Harry W. Brelsford

[57] ABSTRACT

The jig of this invention holds a radial array of separate materials together so that they can be glued, welded, or otherwise secured together. The jig is then removed. A plurality of fingers are pivoted to a common support, and elastic means are used to urge the fingers together to tightly grip the radial array of materials to be held. The finger surfaces are angular to correspond to the angle of the materials to be held and for a cross shaped array of materials, the finger surfaces are at 90° to each other. The fingers have shanks that project beyond the hinge or pivot point and these projecting shanks may be used to open up the fingers by manually grasping the projecting shanks and thereby overcoming the elastic means which normally urges the fingers together.

8 Claims, 10 Drawing Figures

JIG FOR HOLDING MEMBERS IN RADIAL ARRAY

My invention relates to jigs for holding pieces together during gluing, nailing, welding or other fastening operations and has particular reference to a jig for holding members together in a cross shaped relationship, or radiating relationship.

BACKGROUND OF THE INVENTION

In the fabrication of various structures it is often necessary to hold pieces in a cross shaped relationship for gluing, welding, nailing, etc. This is difficult with conventional vices, grippers and clamps because the angular relationship is seldom prefectly achieved. For example, in the construction of T spars and cross shaped spars for model airplane construction there is a common problem of holding the webs accurately while they are fastened together by gluing or welding.

BRIEF SUMMARY OF THE INVENTION

I have devised a jig having a plurality of moveable fingers connected to a common support. The number of fingers depends upon the number of pieces to be fastened and four fingers will hold members together to form T shapes or cross shapes, and five fingers are used to hold five members together in a star array, six for six members etc. I have discovered that I can accommodate a large assortment of material thickness and different thicknesses of material in one array by tapering the adjacent surfaces of the fingers both longitudinally and in cross section. I prefer to use simple biasing structures to hold the fingers together, such as rubber bands and spring bands so that the jig fingers will grip the materials. Alternatively I use spreaders on the finger ends projecting beyond the hinge to cause the fingers to grip the material.

DETAILED DESCRIPTION

Various objects, advantages and features of the invention will be apparent in the following description and claims considered together with the accompanying drawings forming an integral part of the application and in which:

Figure 6:
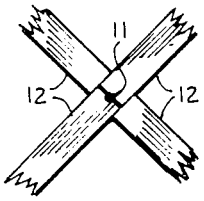
Figure 1:
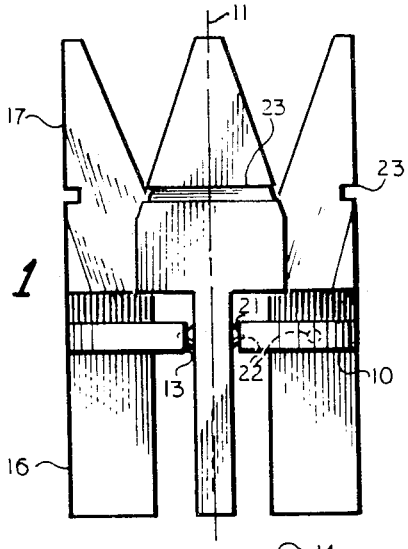
FIG. 1 is an elevation view of a jig incorporating the invention employing four fingers
Figure 4:
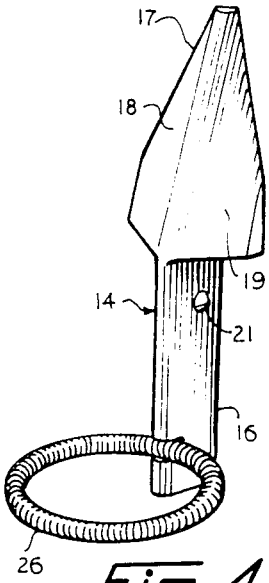
Figure 5:
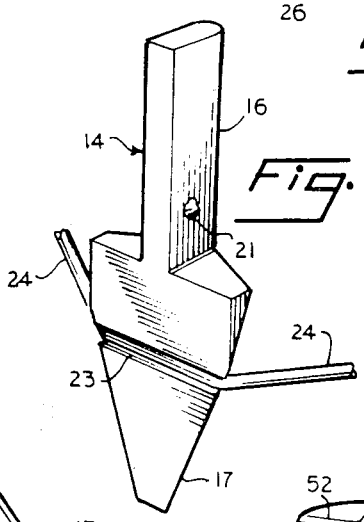

FIG. 4 is a three dimensional view of one of the fingers of FIG. 1 showing also an expansion band for forcing the fingers toward each other FIG. 5 is a three dimensional view of the other side of the finger of FIG. 4 showing a rubber band and/or tension band to pull the fingers together FIG. 6 is a cross section of typical cross shaped members that are held in place by the jig of FIG. 1 for gluing, welding, etc.

Figure 7:
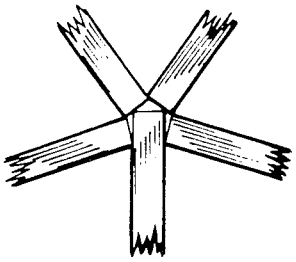
Figure 3:
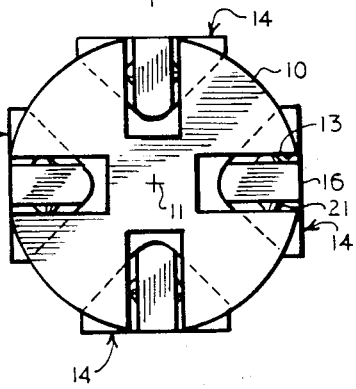
FIG. 3 is a bottom view of the jig of FIG. 1
Figure 8:
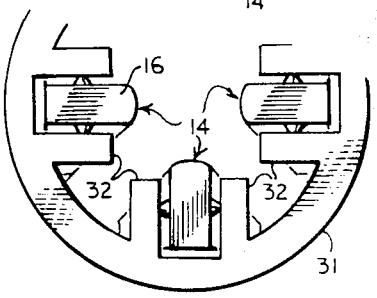

FIG. 7 is a cross sectional view of an assembly of five radiating members which can be held for gluing, welding, etc. by a modified form of the invention employing five fingers FIG. 8 is a bottom view of a modified form of the invention wherein the fingers are mounted on a ring rather than a spider as shown on FIG. 3.

Figure 9:
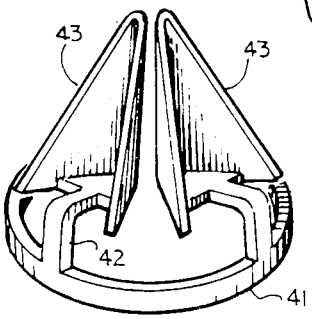

FIG. 9 is a three dimensional fragmentary view of still another modified form of the invention wherein the fingers and the spring urging them together and the ring upon which they are supported are all formed from a single piece of material.

Figure 10:
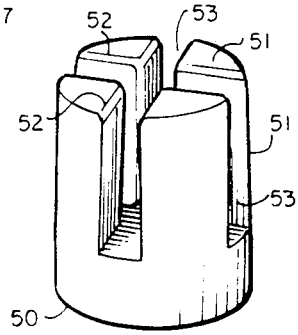

FIG. 10 is a three dimensional view of a modified form of the invention having flexible fingers connected to a common base.

Referring to FIGS. 1, 2, 3 and 6 a spider 10 in the form of a slotted plate is disposed in a plane that is generally transverse to an axis 11 that is the axis transverse to the radiating members of FIG. 6 which members are referred to by 12. The spider 10 has a plurality of slots 13 formed on the outer edge corresponding in number to the number of fingers 14 that are desired for the particular number of pieces to be held together.

Referring to FIGS. 2 thru 5 it will be noted that the fingers 14 have a shank 16 on one end and this is connected to a semipyramidal structure 17 on the other end. The pyramid 17 has two surfaces 18 and 19. When the fingers are to hold pieces togetherin a cross shape as shown in FIG. 6 then these two surfaces 18 and 19 are disposed generally at right angles to each other. If different numbers of pieces are to be held, then these surfaces can be at the appropriate angles to engage the different members to be held. Projecting from each side of the shank 16 is a small cone 21 and these cones fit within conical depressions 22 in the spider 10. By making the spider 10 and the fingers 14 somewhat elastic plastic material, these cones can be fitted into the conical depressions 22 with simple elastic deformation of the cone 21 or the sides of the slots 13 or both.

The fingers 14 are normally urged toward each other by a tension member that is held in slots 23 formed on the flat outer surfaces of the fingers 14. Shown in FIG. 5 is a presently preferred form of tension member; namely, the rubberband 24. Another structure for moving the pyramidal portions 17 of the fingers toward each other is shown in FIG. 4; namely, an expansion spring, ring or web 26 which is inserted between the shank ends 16 of the fingers 14 and this outward movement of the shanks 16 causes the semipyramidal ends 17 to move toward each other to grip members to be held; for example, those shown in FIG. 6.

Shown in FIG. 8 is a modified form of support member for the fingers; namely, a ring 31 having inwardly projecting lugs 32 which hold the finger 14 in the same fashion as described with respect to FIGS. 1 thru 5. The advantage of the ring shape support member of FIG. 8 is that the entire jig can be slipped along the length of members to be held together, for example, those shown in FIGS. 6 and 7.

Shown in FIG. 9 is still another modified form of the invention which can be made of a sheet metal, and which can be drawn from a single sheet of metal. A ring 41 has upwardly projecting spring arms 42 which each support a triangular box 43 having an exterior shape similar to the semipyramidal shape 17, FIG. 4. In this case the support member 41, the means for urging the fingers toward each other namely the spring arm 42 and the fingers themselves 43 are formed of a single piece of material in a unitary structure.

OPERATION

Figure 2:
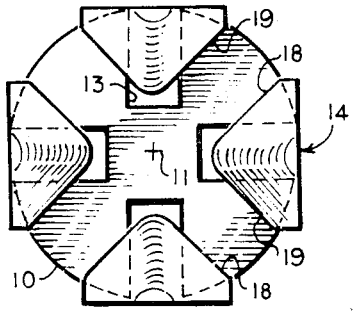
FIG. 2 is a top view of the jig of FIG. 1

Referring now to FIGS. 1, 2, and 3 the jig may have a rubberband disposed in the slots 23 of the semipyramidal ends of the fingers 14. The rubberband 24 is shown in FIG. 5. The fingers will then move all toward each other to touch each other. In order to support cross shape members such as those shown in FIG. 6 the operator then grasps the outwardly projecting shanks 16 of the fingers to overcome the rubberband in the slots 23 and the pyramidal ends 17 of the fingers are then separated so that they can be slipped over the cross shape array of members shown in FIG. 6. The operator then releases his manual pressure on the projecting shanks 16 and the rubberband 24 thereupon tensions the fingers to cause them to engage the cross shape members of FIG. 6. Because of the semipyramidal structure 17 of the fingers 14 the fingers will accurately grip any thickness of material from the dimensions between the fingers shown in FIG. 2 down to tissue like thickness. An alternative form of moving the fingers together is shown in FIG. 4 wherein the expansion spring ring 26 acts on the projecting shanks 16 to urge them outwardly which in turn urges the semipyramids 17 together.

The modification shown in FIG. 8 is operated in the same way as the structure of FIGS. 1 thru 3. The operation of the device of FIG. 9 requires more manual operations and preferably is slid over the cross shape members such as those of FIG. 6 until the fingers 43 grip the member 12 tightly, or it may be added prior to the placement of all members to be joined in the jig which are later inserted between the fingers.

It will be obvious to those skilled in the art that various modifications may be made in my structure. For example, tapered wedges or cones may be used against the outer ends of the shanks 16 to spread them to cause fingers 14 to grip materials. Expansion and tension devices other than those shown may be used; for example, a spider may be used to engage the projecting ends 16 and these could be in toggle form if desired to get a tight grip of the semipyramids 17 on the material to be held. Various hinged structures could be used other than the projecting cone and dimples illustrated. For these and other reasons I do not limit myself to the embodiments shown, as these are merely illustrative and not limiting. Accordingly, all variations, modifications, and improvements are included within the scope of the following claims that fall within the true spirit and scope of my invention.

FIG. 10

Referring to FIG. 10, there is illustrated a base 50 of any desired cross section, having upwardly projecting flexible fingers 51. The ajoining edges of the top of the fingers are tapered or rounded at 52 for easier insertion of materials in spaces 53 between the fingers. The number of fingers 51 and their angular orientation to each other depends upon the number and the array of materials to be held, and the device of FIG. 10 is for four pieces in a cross shaped array, such as that of FIG. 6. The operation of the jig of FIG. 10 differs from FIGS. 1–5 in that no manipulation is required for the fingers 51 and the materials are merely placed in the spaces 53, the rounded edges 52 allowing easy insertion. The jig of FIG. 10 is preferably made of flexible but elastic plastic materials.

I claim:

1. A jig for holding members together in a radiating array having an axis transverse to the radiation comprising:
   (a) a support member;
   (b) several axially extending fingers flexibly mounted to the support member; and having gripping surfaces that are parallel to radii from the jig axis;
   (c) and resilient means for biasing the fingers toward said axis to thereby grip members disposed between the gripping surfaces of the fingers.

2. A jig as set forth in claim 1 wherein the means for biasing the fingers is an elastic band engaging the fingers.

3. A jig as set forth in claim 1 wherein the fingers have shanks that extend beyond the support member and the resilient means biases the shanks outwardly to thereby bias the fingers toward each other.

4. A jig as set forth in claim 1 wherein the support member, the fingers and the biasing means are formed of a single piece of material.

5. A jig as set forth in claim 1 wherein the support member is a ring and the fingers and the biasing means are formed of a single piece of material.

6. A jig as set forth in claim 1 wherein the support is a solid piece of material and the fingers are formed of flexible material, and project from the base, and the fingers and base are formed from a single piece of material.

7. A jig as set forth in claim 1 wherein the flexible mounting includes pivots formed between the fingers and the support member.

8. A jig as set forth in claim 1 wherein the support is a ring to which the fingers are flexibly mounted.

* * * * *